US007210971B1

(12) United States Patent
Micek

(10) Patent No.: US 7,210,971 B1
(45) Date of Patent: May 1, 2007

(54) INJECTOR WIRE CONNECTOR

(75) Inventor: Martin J. Micek, Plymouth, MI (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 11/337,715

(22) Filed: Jan. 23, 2006

(51) Int. Cl.
*H01R 11/22* (2006.01)
*H01R 13/11* (2006.01)

(52) U.S. Cl. ..... 439/851

(58) Field of Classification Search ..... 439/851, 439/852

See application file for complete search history.

(56) References Cited

U.S. PATENT DOCUMENTS

| | | | | | |
|---|---|---|---|---|---|
| 4,304,457 | A | * | 12/1981 | Lissau | 439/851 |
| 4,615,100 | A | | 10/1986 | Reinertz | 29/564.8 |
| 4,772,235 | A | | 9/1988 | Lustig | 439/866 |
| 4,840,587 | A | * | 6/1989 | Lancella | 439/851 |
| 4,857,008 | A | | 8/1989 | Kee et al. | 439/352 |
| 4,906,212 | A | | 3/1990 | Mixon, Jr. | 439/857 |
| 4,923,416 | A | | 5/1990 | Zinn | 439/877 |
| 4,985,004 | A | | 1/1991 | Zinn | 439/851 |
| 5,498,179 | A | | 3/1996 | Byczek | 439/843 |
| 6,012,945 | A | | 1/2000 | Tabor et al. | 439/489 |
| 6,315,592 | B1 | | 11/2001 | Keller et al. | 439/342 |
| 6,443,740 | B1 | | 9/2002 | Evans | 439/63 |
| 6,939,178 | B2 | | 9/2005 | Arcykiewicz et al. | 439/638 |
| 6,945,830 | B2 | | 9/2005 | Copper et al. | 439/852 |
| 6,948,985 | B1 | | 9/2005 | Perz | 439/668 |

* cited by examiner

*Primary Examiner*—Javaid H. Nasri
(74) *Attorney, Agent, or Firm*—Rader, Fishman & Grauer PLLC; Bill C. Panagos

(57) ABSTRACT

A hollow electrical socket connector, having an outside surface and an interior surface to define an interior space adaptable to connectably receive generally cylindrical electrical contact pin. The socket is equipped with at least a double break radius crimp, on its outside surface and extending into said interior space to define a double crimp beam. The double break radius crimp forms at least two contact points in said socket interior to form a vibration resistant electrical connection between said socket and said cylindrical electrical contact pin.

3 Claims, 1 Drawing Sheet

FIG 1
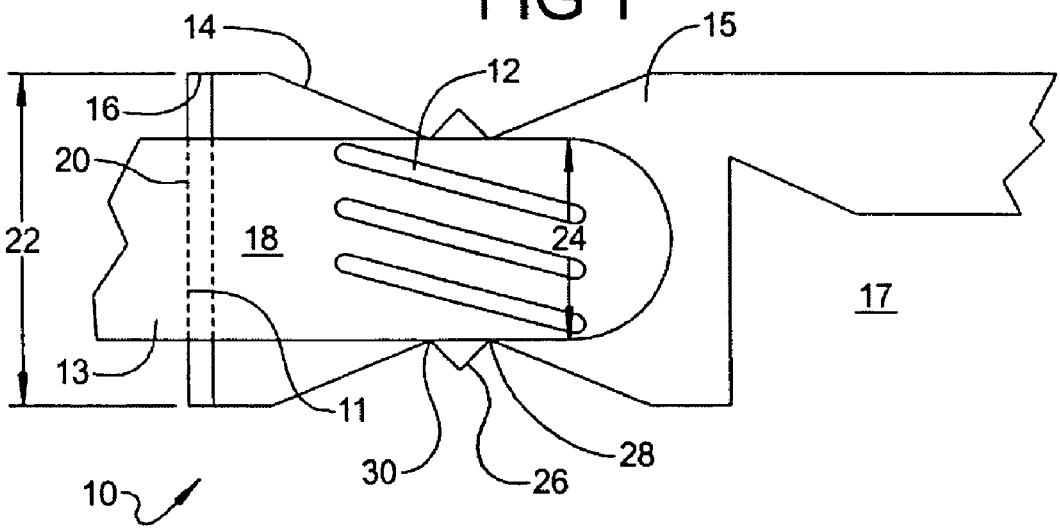
FIG 2
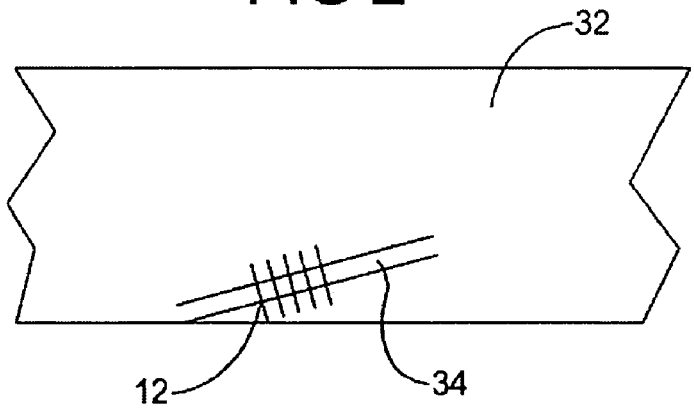
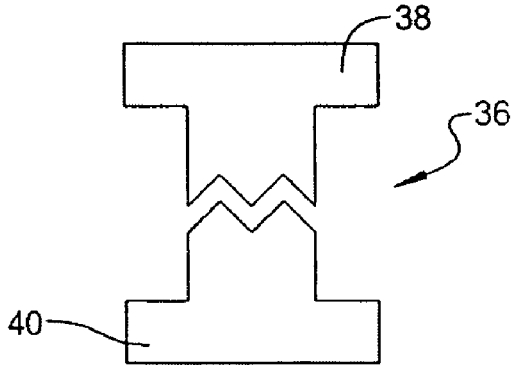
FIG 3

INJECTOR WIRE CONNECTOR

BACKGROUND OF THE INVENTION

1. Field of the Invention

The present invention relates to an electrical connector to facilitate and improve electrical contact between two points.

The present invention further relates to a wire contact clip for use in demanding environments where vibration of the electrical connection is an issue.

The present invention further relates to an injector wire contact clip for use in heavy duty internal combustion engines such as diesel engines. It provides for an improved contact between an electrical contact pin and a socket.

2. Description of the Related Art

Evans, U.S. Pat. No. 6,443,740 discloses a high-speed connector system that includes a shielded header and receptacle with a self-shielded terminal. This differs from the present invention because there is no double crimped contact point per beam but rather a single crimp upon the beam that contacts the pin and causes the connection to the pin. The second crimped point of the Evans '740 contacts to the substrate of the housing holding the pin.

Tabor et al., U.S. Pat. No. 6,012,945 is directed to an electrical connector for connection to a fuel injector. The connector includes a terminal insulator having at least one passage to receive at least one box terminal stacked wire and a connector position with an assurance member cooperating with the terminal insulator to detect and indicate an unmated condition of the terminal insulator. There is no showing of the double crimped beam as set forth in the present invention.

Byczek, U.S. Pat. No. 5,498,179 discloses a female connector element for a pin and a socket electrical connector. The connector includes four flexible fingers or cantilever beams forming a cylindrical socket for the pin of the mating connector. A cylindrical sleeve surrounds the fingers and extends beyond the free end to form an inwardly extending annular guide lip, which defines the inlet opening for the pin. The lip both guides the pin properly into the socket and limits the size of the pin that may be inserted thereby reducing potential damage to the fingers while a providing reliable durable connector. Byczek '179 does not disclose the double crimped beam set forth in the present invention.

Zinn, U.S. Pat. No. 4,985,004 discloses a round pin bushing of a punched sheet metal part defining an elastically deformable pin receiving orifice area. The orifice area is encompassed by an outer spring sleeve slid thereover. Further disclosed is an expansion lock comprising first and second hook pieces on the orifice forming portion which mutually engage when a pin is inserted but provide a radial clearance therebetween for expansion when free of an inserted pin. There is no showing of a double crimped beam to assure contact even in other environments such as fuel injectors.

Zinn, U.S. Pat. No. 4,923,416 discloses a plug prong stamped from a piece of sheet metal with a crimped section and a contact section as well as a transition section between a crimped section and a contact section characterized by a hollow cylindrical base and round pin like hollow cylindrical contact second with a conically rounded tip. The transition is a cylindrically short section between the crimp and the base section while the outside diameter of the base section is greater than the outside diameters of the contact section of the transition section and the outside diameter of the transition section is greater than the diameter of the contact section. There is no showing of a double crimped being as set forth in the present invention.

Mixon, Jr., U.S. Pat. No. 4,906,212 is an electrical socket and pin connector. The socket and pin are made from conductive material by stamping and forming. The socket includes a cylindrical mating portion defined by cantilever beams having one or more blades and wherein some blades include a rearwardly extending free end. The pin includes a mating portion having a bullet nose at one end and a barrel at the other end. Mixon, Jr. '212 does not disclose the use of a stamping tool to create a double break from which to form a double break radius being for use as an electrical connector to a contact pin.

Lustig, U.S. Pat. No. 4,772,235 discloses an electrical connector for terminating an electrical pin wire. The connector comprises a wire barrel having a length and an inside diameter and the wire barrel is mechanically crimped to provide at least one point of electrical mechanical connection to the electrically conducted portion. There is no showing of the use of a stamping process to form a double break in a stamping strip from which to form a double break radius beam to secure an electrical connection.

Reinertz, U.S. Pat. No. 4,615,100 discloses a crimping process in crimping apparatus for carrying out the process. There is no showing of using the apparatus to double crimp the beam.

The present invention is directed to an electrical socket connection with a double break radius formed between two control beams to provide improved strength to the connector and improved vibration resistance to the contact points.

SUMMARY OF THE INVENTION

The present invention is a hollow electrical socket connector having an outside surface and an interior surface. The socket defines an interior space adaptable to connectively receive a generally cylindrical electrical contact pin. The socket is equipped with at least a double break radius crimp to form a double contact beam on the outside surface and the crimps extend into the interior space to provide for improved contact between a socket and the electrical contact pin. The improved contact achieved by the double break radius crimp also forms a vibration resisting electrical connection between the socket and the electrical pin. Further, the use of the double crimp radius provides for additional strength to the socket connection.

The present invention further relates to a method to manufacture a hollow socket connector having an outside surface and an interior surface to define an interior space. The process to manufacture the double break radius connector is to form at least one slot in a stamping strip of material to form a double break in the stamping material the double break intercepting with the slots and then forming the socket connector in a stamping process using a die and a punch.

These and other aspects of the invention will become apparent upon a reading of the detailed description of the preferred embodiment.

BRIEF DESCRIPTION OF THE DRAWINGS

FIG. 1 is a side view of the electrical connector of the present invention showing the double break radius crimp and interaction with one of the cylindrical contact pins.

FIG. 2 is a section of a stamping strip showing the slots formed therein and the double break that intersects the slots.

FIG. 3 is a view of the tool to form the double break radius socket connector of the present invention.

DETAILED DESCRIPTION OF THE PREFERRED EMBODIMENTS

Turning now to the drawings wherein like numerals refer to like structures, and particularly to FIG. 1, there shown therein a hollow electrical socket connector 10 with a cylindrical electrical contact pin 13 inserted therein. The electrical socket has an outside surface 14 and an inside surface 16 to define a hollow interior space 18. The connector has an orifice 20 that extends the entire inside diameter 22 of the socket connector at a first end 11, and is large enough to accommodate the diameter 24 of the electrical contact pin. The socket is connected at its second end 15 to injector 17. Along the outside surface above the connector is at least one expansion slot 12 and preferably more than one such expansion slot extending along the length of the socket and preferably at an angle to promote expansive flexibility of the socket to accommodate the electrical pins. Circumferentially disposed at some point between either end of the socket is a double break radius 26 which circumferentially formed along the outside surface of the socket. On either side of the double break radius are contact beams 28 and 30 that also traverse the socket circumferentially and extend into the interior space of the socket to contact the cylindrical electrical contact pin to secure the pin into the socket. The double break radius which is formed in the socket imparts parts improved strength to the hollow electrical socket and together with the double contact beams and expansive slots provide for an electrical socket connection with the contact pin that resists loosening by vibration or other environmental factors such as one would encounter in heavy duty applications such as an internal combustion engine compartments or other vehicular connections. The described connection is also particularly advantageous for use in fuel injectors where the vibration of the engine is such that the electrical connection between the fuel injector and the ECM is subject to vibration force. It is not uncommon for the electrical connection between the fuel injector and the ECM to become disconnected due to the vibration forces encountered in the operation of internal combustion engines in particularly heavy duty diesel engines.

Having thus described the structure of the double break radius electrical socket connector, reference is made to FIG. 2 wherein a section of stamping material 32, possibly a metal or other electrically conductive material, is shown. Slots 12 are formed therein at an angle relative to the perpendicular. A double break 34 is further provided in the stamping material that intersects the slots at right angles. The stamping material is then formed through the die and punch tool 36 of FIG. 3 wherein the die 38 is complimentary to the punch 40 and forms a double break radius therein via a stamping process such as is known in the art. Those skilled in the art can understand that multiple radius can be employed to form the wire connector as described.

As the applicant has described one embodiment of this invention, it will be apparent to those skilled in the art that many variations and modifications are possible without departing from the scope spirit of the appended claims.

I claim:

1. A hollow electrical socket connector, having an outside surface and an interior surface to define an interior space and an orifice at a first end adaptable to connectably receive generally cylindrical electrical contact pin; said socket equipped with at least a double break radius crimp, circumferentially disposed on its outside surface and extending into said interior space to define a double crimp beam; said double break radius crimp forming at least two contact points in said socket interior to form a vibration resistant electrical connection between said socket and said cylindrical electrical contact pin.

2. The socket connector of 1, wherein said socket is equipped with at least one slot formed therein to import flexibility to the socket to improve engagement between said socket and said contact pin.

3. The socket connector in claim 2, wherein said socket is equipped with a plurality of slots to import flexibility to the socket to improve circumferential engagement between said socket and said contact pin.

* * * * *